US007416432B2

(12) United States Patent
Shi et al.

(10) Patent No.: US 7,416,432 B2
(45) Date of Patent: Aug. 26, 2008

(54) CABLE CONNECTOR ASSEMBLY

(75) Inventors: Hou-Yu Shi, Kunshan (CN); Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,881

(22) Filed: Aug. 22, 2007

(65) Prior Publication Data

US 2008/0050963 A1 Feb. 28, 2008

(51) Int. Cl.
*H01R 13/627* (2006.01)

(52) U.S. Cl. ..... 439/362; 439/610; 439/902

(58) Field of Classification Search ..... 439/362, 439/610, 902

See application file for complete search history.

(56) References Cited

U.S. PATENT DOCUMENTS 6,059,599 A 5/2000 Huang
6,083,031 A * 7/2000 Kuo ..... 439/362
6,582,244 B2 * 6/2003 Fogg et al. ..... 439/362

* cited by examiner

*Primary Examiner*—Tho D Ta
(74) *Attorney, Agent, or Firm*—Wei Te Chung

(57) ABSTRACT

A cable connector assembly includes a cover with a receiving space, a first open on one side thereof, a second open opening along a direction perpendicular to the first open and a third open, an electrical connector received the first open, a cable bounding a plurality of wires therein with one end electrically connecting to the electrical connector and the other end extending out of the cover through the second open, a longer first bolt located at one side of the first open and extending through a passage formed in the cover to disclose the two opposite ends out of the cover, and a shorter second bolt located at the other side of the first open opposite to the first bolt, and comprising an operation portion received in the third open of the cover and exposed out of the cover; wherein the second open and the third open are located at the same side of the electrical connector, and the distance between the third open and the first open is less than the distance between the second open and the first open.

17 Claims, 5 Drawing Sheets

CABLE CONNECTOR ASSEMBLY

BACKGROUND OF THE INVENTION

1. Field of the Invention

The present invention relates generally to a cable connector assembly, and more particularly to a cable connector assembly having a cable exiting from a direction perpendicular to a mating direction of an electrical connector.

2. Description of the Prior Art

The interconnection among different electronic devices is always through connectors and cables. To adapt to different kinds of relative positions among the electronic devices, sometimes a cable may be bent to a certain angle. So that one end of the cable connects a connector in a first direction and the other end of the cable connects the connector in a second direction different from the first direction. However, most of the times there are many cables or wires tied together to form a bundle of cable. Thus, it is difficult to bend a whole bundle of cable. For solving the above problem, front ends of the cable are usually received inside the connector. Therefore, the cable can be bent simply.

U.S. Pat. No. 6,059,599 discloses a cable connector assembly comprising a cover, an electrical connector, a group of cable, a shielding case and a pair of bolts. The electrical connector is received in a first open of the cover, and one end of the cable connects the electrical connector and the other end of the cable extend out the cover through a second open of the cover. The first open is perpendicular to the second open, so the cable has two exits in different directions. However, the pair of the bolts, disclosed in this patent, goes through the cover from a first side of the cover to a second side opposite to the first side. So it is obvious that the pair of bolts have gone through the shielding case. Thus, the protection from EMI (Electromagnetic Interference) provided by the shielding case is influenced. Furthermore, the design of the bolt crossing the cable make the front-back length of the whole cable connector assembly relatively big. So it needs to improve the prior art.

Hence, an improved cable connector assembly is desired to overcome the above-mentioned shortcomings of the cable connector assembly.

BRIEF SUMMARY OF THE INVENTION

A primary object, therefore, of the present invention is to provide a cable connector assembly with a compact-size, desired effect of protection from EMI and operation conveniently.

In order to implement the above object and overcomes the above-identified deficiencies in the prior art, the cable connector assembly comprises a cover with a receiving space, a first open on one side thereof, a second open opening along a direction perpendicular to the first open and a third open, an electrical connector received the first open, a cable bounding a plurality of wires therein with one end electrically connecting to the electrical connector and the other end extending out of the cover through the second open, a longer first bolt located at one side of the first open and extending through a passage formed in the cover to disclose the two opposite ends out of the cover, and a shorter second bolt located at the other side of the first open opposite to the first bolt, and comprising an operation portion received in the third open of the cover and exposed out of the cover; wherein the second open and the third open are located at the same side of the electrical connector, and the distance between the third open and the first open is less than the distance between the second open and the first open.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
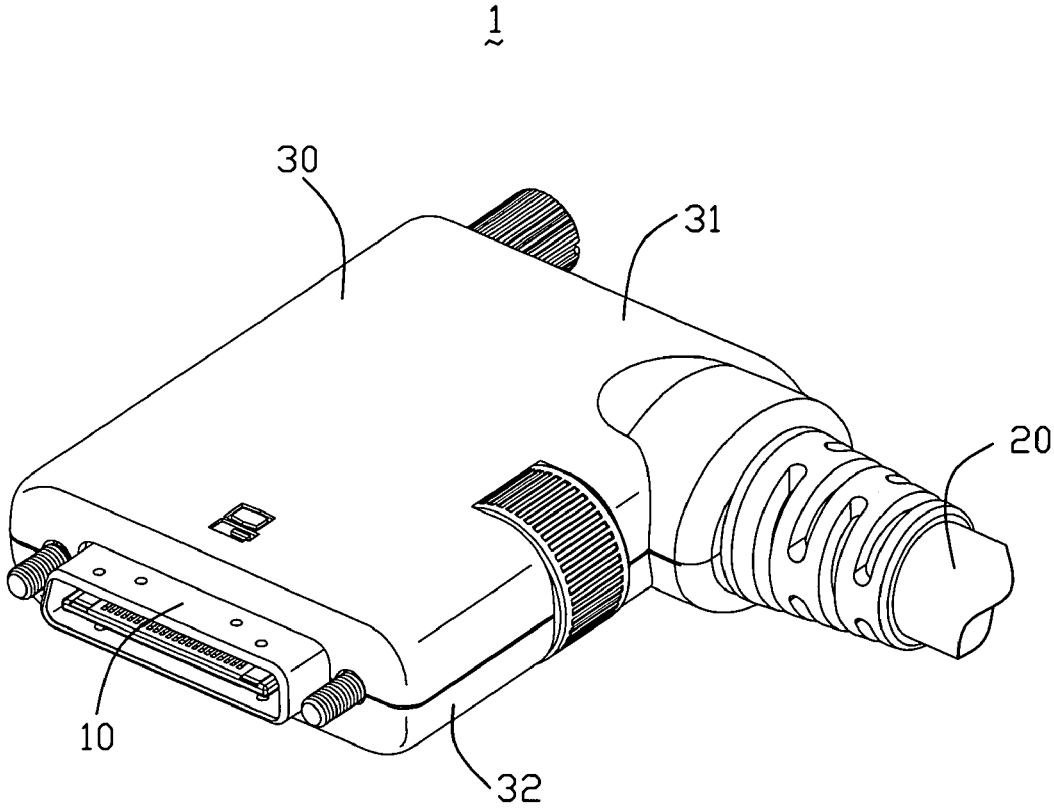
FIG. 1 is a perspective view illustrating a preferred embodiment of a cable connector assembly of the present invention.
Figure 2:
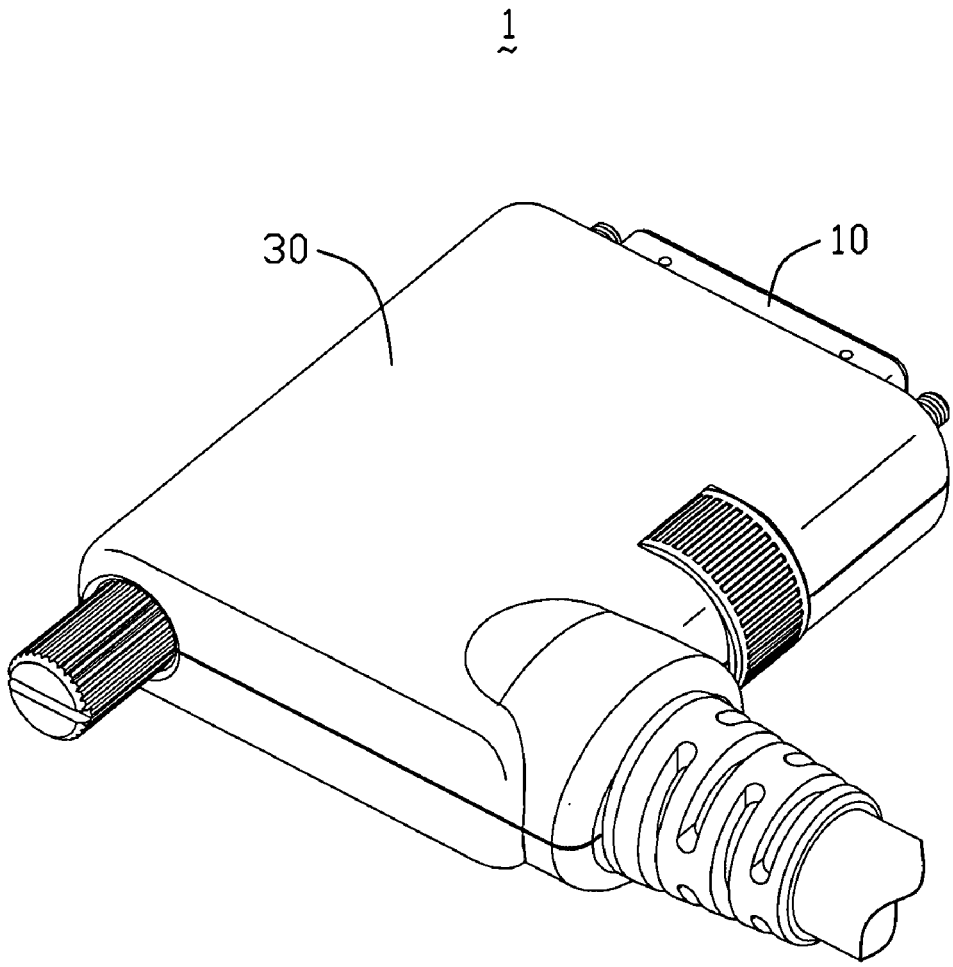
FIG. 2 is a view similar to FIG. 1, but viewed from different angles.
Figure 3:
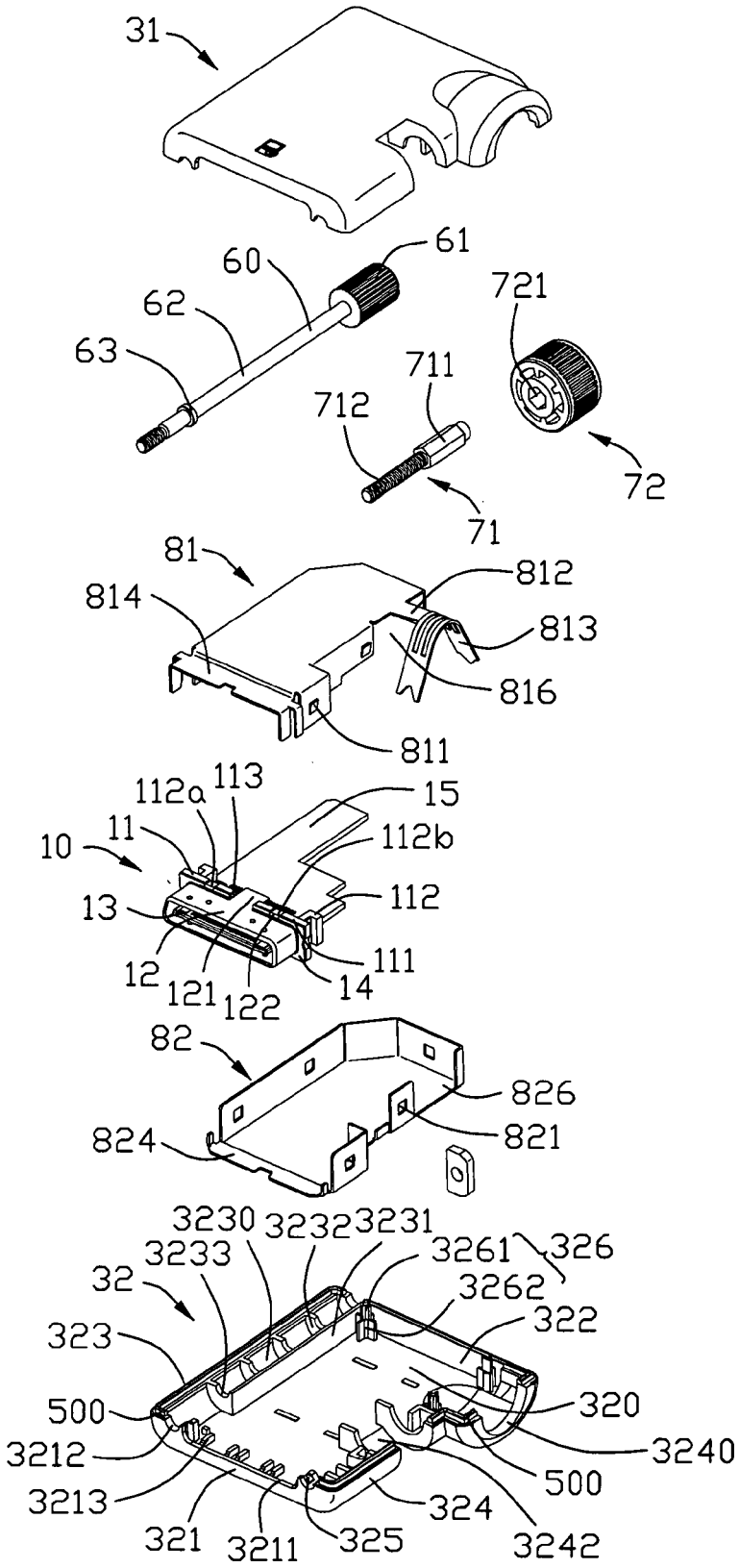
FIG. 3 is an exploded, perspective view of FIG. 1.
Figure 4:
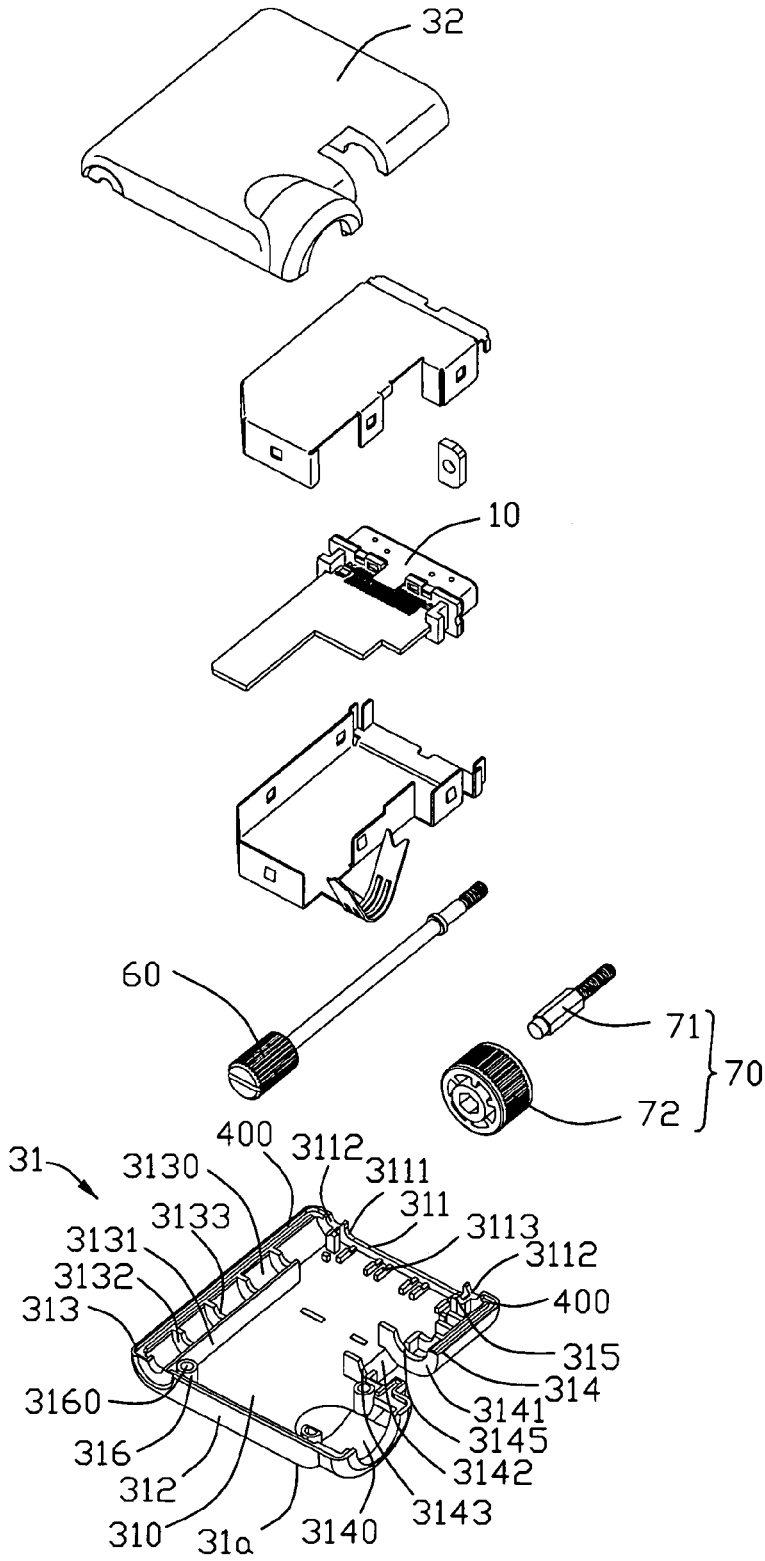
FIG. 4 is a view similar to FIG. 3, but viewed from a different angle.

Reference to FIGS. 1-2, assembled, perspective views of a cable connector assembly 1 in accordance with a preferred embodiment of the present invention are shown, but viewed from different angles. FIGS. 3-4 show exploded, perspective views of FIG. 1, but viewed from different angles.

The cable connector assembly 1 comprises an electrical connector 10, a cable 20 bounding a plurality of wires therein with one end connecting the electrical connector 10 and an L-shape cover 30.

The cover 30 comprises an upper half 31 and a lower half 32. The upper half 31 shown in FIG. 4 comprises a main body 310, and the main body 310 has four walls downwardly respectively extending from the four sides thereof to form a shorter first front wall 311, a first rear wall 312, an arc first left wall 313 and an arc first right wall 314. The first front wall 311 has a long groove 3111 and a pair of semicircular gaps 3112 located on two sides of the groove 3111. Some pads 3113 and a supporting half 315 extend downwardly from the bottom surface of the main body 310 and adjacent to the first front wall 311 and the first right wall 314. An inner rib 3131 extends from the lower half 32 toward the upper half 31 and locates adjacent to the first left wall 313, which is apart from the first left wall 313 to form a semicircular first receiving channel 3130. Some supporting walls 3132 connects the first left wall 313 and the inner wall 3131 and parallel to one another with upper edges defining a semicircular gap 3133 corresponding to one of the semicircular gap 3112. All semicircular gaps 3133, the one semicircular gap 3112 adjacent to the first left wall 313 and a gap defined on the first rear wall 312 correspond to one another to form a passage. The first right wall 314 forms a receiving half 3142 opened toward outside defined by cutting the central section of the first right wall 314 and a semicircular exit open 3140 opened toward outside circled by a semicircular wall extending outward from the first right wall 314. The receiving half 3142 extends inward from the right wall 314 in a direction perpendicular to the right wall 314 to form a first lateral wall 3141 and a second lateral wall 3143. The two lateral walls 3141, 3142 have an arc half 3145 to form a receiving space. Both the left wall 313 and the right wall 314 have a slit 400 on their lower surfaces. Two positioning posts 316 extend downward from the main body 310 with a receiving groove 3160 in the middle thereof.

Reference to FIG. 3, the lower half 32 has a structure being in mirror images relative to a structure of the upper half 31. The lower half 32 also comprises a main body 320, and four walls 321, 322, 323, 324 respectively corresponding to the four walls 311, 312, 313, 314 of the upper half 310. The walls 323, 324 have ribs 500 corresponding to the slits 400 of the upper half 310. Two standoffs 3262 with two posts 3261 thereon form two fixing halves 326. The ribs 500 can be interferentially inserted into the slits 400 and the two fixing halves 326 can be interferentially plug into the two positioning posts 316, thus, the upper half 310 is assembled with the lower half 320 together to form an inner receiving space. The lower half 320 also comprises a groove 3211, a pair of semicircular gaps 3212, some pads 3213, a fixing half 325, a receiving channel 3230, a semicircular open 3240 and a receiving half 3242, and all of these components respectively correspond to the groove 3111, the pair of semicircular gaps 3112, the pads 3113, the fixing half 315, the receiving channel 3130, and the semicircular exit open 3140 of the upper half 310 to form a mirror image. The pads 3113, 3213 of the upper and lower halves are used to fix the electrical connector 10 better.

Reference to FIG. 3, the electrical connector 10 comprises a housing 11, a front mating portion 12 in front of the housing 11, a plurality of conductors 13 and a conductive plate 14. The housing 11 comprises a lengthwise wall 111 and a pair of blocks 112 extending rearward from the lengthwise wall 111. The lengthwise wall 111 has a cutout 113 in the middle of upper surface thereof and a pair of notches 112*a*, 112*b* on the two sides of the cutout 113. The lengthwise wall 111 impinges on the conductive plate 14 and the conductive plate 14 has a middle open and two side opens respectively corresponding to the cutout 113 and the two notches 112*a*, 112*b*. A rectangle patch 121 extends rearward from the mating portion 12 and goes through the middle open of the conductive portion 14 and the cutout 113 of the housing 11 to be exposed in the receiving space of the cover 3. A pair of flexible pieces 122 extend rearward from the mating portion 12 and are respectively received in the notches 112*a*, 112*b*. The electrical connector 10 connects a PCB 15 which is of substantially L-shape via the conductors 13 to electrically connect the cable 20.

The cable connector assembly 1 has fastening means which comprises a first bolt 60 and a second bolt 70. The first bolt 60 is integrated made and comprises a first operation portion 61, a longer media portion 62 whose end has screw thread 64 and a protuberant ring 63. The first operation portion 61 is slotted for operating conveniently. The second bolt 70 comprises a large second operation portion 72 and a shorter screw 71 assembled to the second operation portion 72. The second operation portion 72 has a hexagonal hole 721 in the middle thereof, and the screw 71 has a hexagonal fixing portion 711 and a staff 712 with screw thread on the end thereof. The fixing portion 711 is interferentially inserted in the hexagonal hole 721 to assemble the fixing portion 711 with the hole 721 together.

Figure 5:
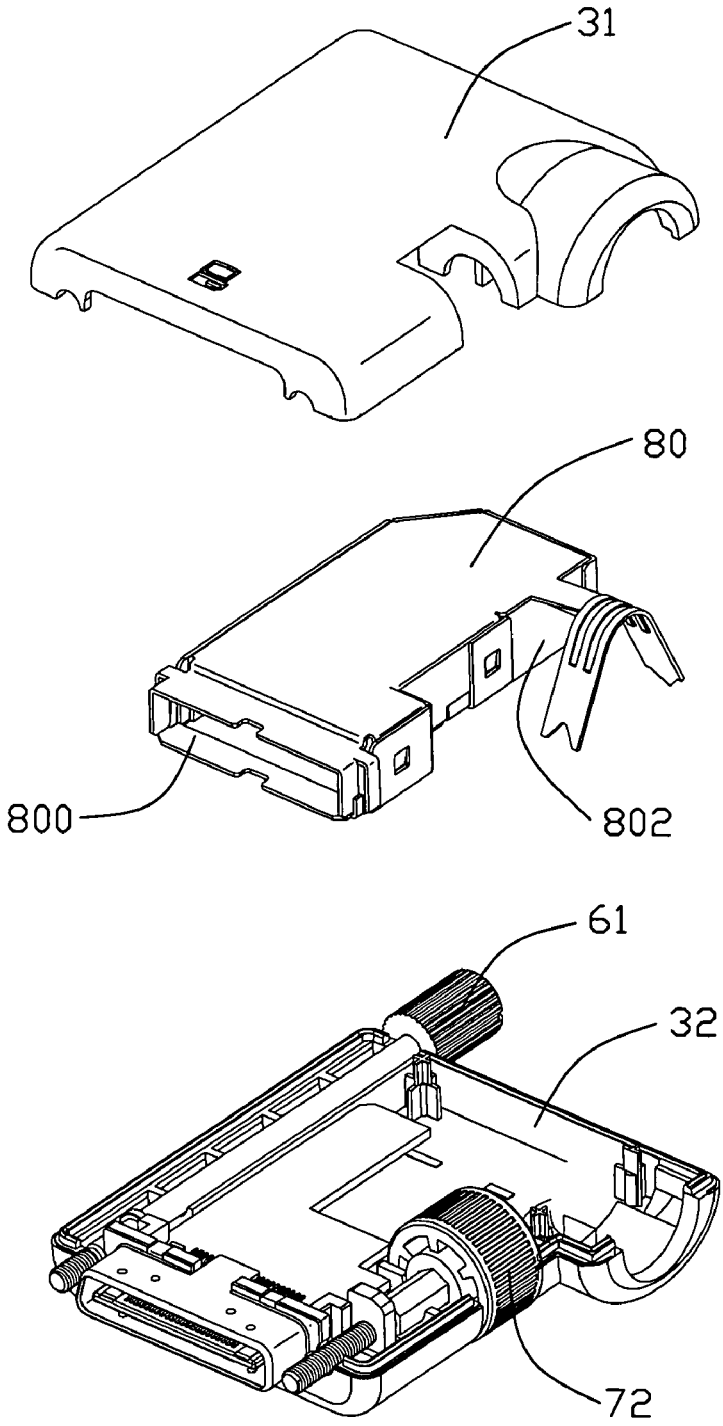
FIG. 5 is a partially assembled view of FIG. 3.

Reference to FIGS. 3-5, the cable connector assembly 1 also comprises a shielding case 80 to prevent the EMI. The shielding case 80 comprises an L-shape upper section 81 and a rectangular lower section 82. The upper section 81 comprises some heaves 811 on the lateral walls thereof, a metal patch 812 extending vertically from one side wall of the shielding case 80 and a U-shape grasping portion 813 formed on the end of the metal patch 812. The lower section 82 comprises some apertures 821 in lateral walls thereof corresponding to the heaves 811 of the upper section 81 and the heaves 811 can engage into the apertures 821 to assemble the upper section 81 with the lower section 82 together. An open 816 defined by the upper section 81 corresponds to an open 826 of the lower section 82 to form a close rectangular existing open 802. A receiving portion 800 is located on the front of the shielding case 80 and defined by a first receiving portion 814 of the upper section 81 and a second receiving portion 824 of the lower section 82. The receiving portion 800 is designed to adapt to receive and fix the electrical connector 10. The housing 11 clings to the first and second receive portions 814, 824 and the two fronts of the receive portions 814, 824 closely contact the conductive portion 14. The PCB 15 and a part of the cable 20 are received in the shielding case 80. After the electrical connection between the PCB 15 and the cable 20 is achieved, the cable 20 firstly extends from the PCB 15, and then bends to go through the existing open 802 to extend outward the shielding case 80 with a portion of the cable 20 is grasped by the grasping portion 813.

In assembly, firstly, the cable 20 are soldered on the PCB 15 and then the cable 20, the PCB 15 and the electrical connector 10 are assembled together. Secondly, the cable 20 is bend to form an angle and the upper section 81 and the lower section 82 are assembled together with the cooperation of the heaves 811 and the apertures 821 to form the closed shielding case 80 in which the PCB 15, a portion of the cable 20 and a part of the electrical connector 10 are and which the front part of the electrical connector 10 is in front of. Wherein the pair of the blocks 12 of the electrical connector 10 are received in the receiving portion 800 to fix the electrical on the shielding case 80 immovably. The bended cable 20 extends out the closed shielding case 80 via the rectangular existing open 802 along a direction perpendicular to the mating direction of the electrical connector 10. Thirdly, the close shielding case 80 with the electrical connector 10, the PCB 15 and the cable 20 is assembled on the lower half 32. Wherein the receiving portion 800 is on the pads 3213 and the housing 11 of the electrical connector 10 is in the space among the pads 3213 and the front wall 321 so that the electrical connector 10 is fixed on the lower half immovably. Fourthly, the first bolt 60 is assembled on the lower half 32, wherein the first bolt 60 is received in the receiving channel 3230 and its end extends beyond the semicircular gap 3212 corresponding to the receiving channel 3230 to expose out the lower half 32. The second bolt 70 is assembled on the upper half 31, wherein the second operation portion 72 is received in the receiving half 3145 of the upper half 31 and the screw 71 extends forward the upper half 31 to go through the semicircular gap 3112 corresponding to the receiving half 3142 to disclose out of the upper half 31. And then the upper half 31 is assembled with the lower half 32 together to form the receiving space, and the PCB 15, a part of electrical connector 10 and cable 20, the shielding case 80 are all in the receiving space. The first operation portion 61 of the first bolt 60 is exposed out of the cover 30. The second operation portion 72 of the second bolt 70 is received in the receiving space defined by the receiving half 3142, 3242 to connect the outer space of the cover 30, thus, most of the second operation portion 72 is exposed out of the cover 30. The electrical connector 10 extends along a direction perpendicular to the front walls 312, 322 to go through the passage formed by the grooves 3111, 3211 to disclose out of the cover 30. The cable 20 bends to extend out the cover 30 via a circular open formed by the semicircular exiting opens 3140, 3240. The upper half 31 and the lower half 32 are fixed by the engaging means defined by the positing holes 316 of the upper half 31 and the fixing halves 326 of the lower half 32.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable connector assembly comprises:

a cover with a receiving space, a first open on one side thereof, a second open opening along a direction perpendicular to the first open and a third open;

an electrical connector received the first open;

a cable bounding a plurality of wires therein with one end electrically connecting to the electrical connector and the other end extending out of the cover through the second open;

a longer first bolt located at one side of the first open and extending through a passage formed in the cover to disclose the two opposite ends out of the cover; and a shorter second bolt located at the other side of the first open opposite to the first bolt, and comprising an operation portion received in the third open of the cover and exposed out of the cover;

wherein the second open and the third open are located at the same side of the electrical connector, and the distance between the third open and the first open is less than the distance between the second open and the first open;

wherein said cover has a upper surface, a lower surface, a front surface, a rear surface and two side surfaces, the first operation portion only communicates with the rear surface but the second operation portion communicates with the upper surface, lower surface and one of the two side surface.

2. The cable connector assembly as claimed in claim 1, wherein said third open connect the upper surface and the lower surface of the cover with the side surface of the cover on which the second open locates to expose most part thereof outside of the cover.

3. The cable connector assembly as claimed in 1, wherein said cover comprises an upper half and a lower half.

4. The cable connector assembly as claimed in claim 1, wherein said first bolt comprises a longer media portion extending through the cover to disclose an end out the first open and a first operation portion connecting the other end of the longer media portion to disclose out of one side of cover opposite to the first open.

5. The cable connector assembly as claimed in claim 4, wherein said first bolt is integrally formed from metal material.

6. The cable connector assembly as claimed in claim 5, wherein said operation portion received in the third open of the cover is a portion of the second bolt to form a larger second operation portion, the second bolt also comprises a shorter screw located in a channel in the cover assembled with the operation portion to form a complete piece.

7. The cable connector assembly as claimed in claim 6, wherein said second operation portion is located in a receiving portion defined by the cover communicating with the outer space cover.

8. The cable connector assembly as claimed in claim 7, wherein said second operation portion of the second bolt is located on the side of the cover opposite to the first bolt.

9. The cable connector assembly as claimed in claim 7, wherein said electrical connector exposes out of and in front of the front surface of the cover, both the longer media portion and the shorter screw have an end locate in front of the front surface and on two opposite sides of the electrical connector respectively.

10. The cable connector assembly as claimed in claim 1, further comprising a shielding case in the cover to shield the joint of the electrical connector and the cable.

11. The cable connector assembly as claimed in claim 10, wherein said the electrical connector is located in the first open of the shielding case, the cable connect the electrical connector and extends form the electrical connector to be out of the shielding case through a second open of the shielding case.

12. The cable connector assembly as claimed in claim 11, wherein said cable extends outward the cover in a direction perpendicular to the mating direction of the electrical connector.

13. The cable connector assembly as claimed in claim 11, wherein said cable extends outward the cover in a direction perpendicular to the mating direction of the electrical connector.

14. The cable connector assembly as claimed in claim 11, wherein said shielding case comprises a U-shape grasping portion to grasp a portion of the cable.

15. The cable connector assembly as claimed in claim 11, wherein said shielding case comprises an L-shape upper section and a rectangular lower section, and the upper section has a metal patch extending vertical therefrom and a U-shape grasping portion formed on the end of the metal patch.

16. A cable connector assembly comprising:

an insulative housing defining a mating port having a plurality of contacts therein for mating with a complementary connector along a front-to-back direction;

a cover enclosing said housing except said mating port;

a cable extending from a rear end of the cover along a direction angled with said front-to-back direction;

a first screw piece positioned on one lateral side of the cover, extending along said front-to-back direction, and essentially located in front of said cable; wherein said first screw is actuated by a first operation rotor which is exposed horizontally on said lateral side and only laterally accessible from an exterior, rotatable relative to the first screw, and rotated only without axial movement;

further including a second screw piece positioned on the other lateral side of the cover which is longer than the first screw piece;

wherein said second screw is acutator by a second operation rotor which is accessible from said exterior both laterally and forwardly, and not only rotated but also axially moveable.

17. The cable connector assembly as claimed in claim 16, wherein said direction is perpendicular to the front-to back direction.

* * * * *